United States Patent [19]

Saito et al.

[11] Patent Number: 4,825,535

[45] Date of Patent: May 2, 1989

[54] METHOD OF MANUFACTURING A RESISTOR ELEMENT

[75] Inventors: Tsunenari Saito, Tokyo; Kazuyuki Ota, Chiba; Teruyasu Suzuki, Kanagawa; Keiji Honda, Aichi; Takahiko Yamakami, Mie, all of Japan

[73] Assignee: Sony Corporation, Tokyo, Japan

[21] Appl. No.: 153,444

[22] Filed: Feb. 8, 1988

[30] Foreign Application Priority Data

Feb. 10, 1987 [JP] Japan ..... 62-029354

[51] Int. Cl.[4] ..... H01C 17/02

[52] U.S. Cl. ..... 29/613; 29/610.1; 29/620; 264/61

[58] Field of Search ..... 29/610, 613, 620; 264/61, 345, 346; 338/275, 21; 313/477 HC, 479

[56] References Cited

U.S. PATENT DOCUMENTS 1,978,323 10/1934 Power ..... 29/620

3,919,682 11/1975 Costa ..... 29/613

*Primary Examiner*—P. W. Echols

[57] ABSTRACT

A method of manufacturing a resistor element, particularly one for use as an arc suppressing resistor in a cathode ray tube which consists in providing an arc suppressing resistor having a resistor core of predetermined resistance covered with an integral ceramic insulating layer, and baking the resistor in a vacuum atmosphere at a vacuum ranging from $1\times10^{-3}$ Torr to $1\times10^{-7}$ Torr, a temperature from 250° to 500° C. and a treatment time or more than 30 minutes.

6 Claims, 3 Drawing Sheets

FIG. 5

| Treatment Temperature (°C) | | Degree of Vacuum (Torr) | | | | | | | | | | | | | | | |
|---|---|---|---|---|---|---|---|---|---|---|---|---|---|---|---|---|---|
| | | $1 \times 10^{-3}$ | | | | $1 \times 10^{-4}$ | | | | $1 \times 10^{-6}$ | | | | $1 \times 10^{-7}$ | | | |
| | | Treatment Time (minute) | | | | Treatment Time (minute) | | | | Treatment Time (minute) | | | | Treatment Time (minute) | | | |
| | | 15 | 30 | 60 | 120 | 15 | 30 | 60 | 120 | 15 | 30 | 60 | 120 | 15 | 30 | 60 | 120 |
| 120 | Value After Accelerated Test | X | X | X | X | X | X | ○ | ○ | X | △ | ○ | ○ | X | △ | ○ | ○ |
| | Variation with the Lapse of Time | X | X | X | X | X | X | △ | △ | X | △ | △ | △ | X | △ | △ | △ |
| 200 | Value After Accelerated Test | X | X | X | △ | △ | ○ | ○ | ◎ | ○ | ○ | ◎ | ◎ | ○ | ◎ | ◎ | ◎ |
| | Variation With the Lapse of Time | X | X | X | X | X | △ | ○ | ◎ | △ | ○ | ◎ | ◎ | △ | ○ | ◎ | ◎ |
| 250 | Value After Accelerated Test | X | X | X | ○ | △ | △ | ◎ | ◎ | ○ | ○ | ◎ | ◎ | ○ | ◎ | ◎ | ◎ |
| | Variation With the Lapse of Time | X | X | X | △ | X | △ | ◎ | ◎ | △ | ○ | ◎ | ◎ | △ | ◎ | ◎ | ◎ |
| 300 | Value After Accelerated Test | △ | ○ | ○ | ○ | ○ | ○ | ◎ | ◎ | ○ | ◎ | ◎ | ◎ | ○ | ◎ | ◎ | ◎ |
| | Variation With the Lapse of Time | X | △ | △ | △ | △ | ○ | ◎ | ◎ | ○ | ○ | ◎ | ◎ | ○ | ◎ | ◎ | ◎ |
| 400 | Value After Accelerated Test | ○ | ○ | ◎ | ◎ | ○ | ◎ | ◎ | ◎ | ○ | ◎ | ◎ | ◎ | ○ | ◎ | ◎ | ◎ |
| | Variation With the Lapse of Time | △ | ○ | ◎ | ◎ | △ | ◎ | ◎ | ◎ | ○ | ○ | ◎ | ◎ | ○ | ◎ | ◎ | ◎ |
| 500 | Value After Accelerated Test | ○ | ○ | ◎ | ◎ | ○ | ◎ | ◎ | ◎ | ◎ | ◎ | ◎ | ◎ | ◎ | ◎ | ◎ | ◎ |
| | Variation With the Lapse of Time | △ | ○ | ◎ | ◎ | ○ | ◎ | ◎ | ◎ | ○ | ◎ | ◎ | ◎ | ○ | ◎ | ◎ | ◎ |

METHOD OF MANUFACTURING A RESISTOR ELEMENT

BACKGROUND OF THE INVENTION

1. Field of the Invention

The present invention is in the field of manufacturing a resistor, particularly an arc suppression resistor employed in a cathode ray tube to suppress the harmful influence of an arc discharge which may accidentally occur within the cathode ray tube.

2. Description of the Prior Art

In the prior art, a cathode ray tube for use with a television receiver is designed and manufactured with great care in order to avoid a discharge occurring within the cathode ray tube, and particularly, to prevent an arc discharge from occurring between the electrodes of an electron gun or between an electrode and some other portion. However, it has been found that a discharge occurring due to various accidental causes can not be avoided completely. If the cathode ray tube is not provided with proper means for avoiding such a defect, an extremely large current flows along the discharge path, burning out the electrodes, breaking the interconnection between the electrodes due to the burning of the connection wire, or damaging the circuitry or the like of the television receiver, and the like. To cope with this problem caused by the discharge current, there has been suggested a method which is known as the soft-flash method. In this method, there is provided an inner conductive film of high resistance on the inner surface of the tube envelope. The discharge energy is thus dissipated within the conductive film. Alternatively, it has been proposed to employ a high value resistor as the conductive connection wire for connecting the electrodes that form the electron gun.

FIG. 1 illustrates an example of a cathode ray tube that employs a resistor having a high resistance according to the latter method. As illustrated in FIG. 1, the cathode ray tube has an electron gun 1 located within a neck portion 3 of a tube envelope 2. The electron gun 1 comprises a cathode K and first to fifth grids G1 to G5 in that order. The third to fifth grids G3 to G5 constitute a unipotential type main electron lens. The third and fifth grids G3 and G5 have applied a high voltage, that is, an anode voltage similar to that applied to the phosphor screen (not shown). The third and fifth grids G3 and G5 are energized as follows. The free end of a flexible metal lead member 6 is placed in resilient contact with an inner conductive layer 5. The inner conductive layer 5 is made of a graphite coated layer or the like coated on the inner surface of a funnel portion 4 of the tube envelope 2 and which has applied to it a high voltage. The flexible metal lead member 6 is attached to the fifth grid G5. Further, the fifth and third grids G5 and G3 are connected to each other by a resistor having a high resistance, that is, an arc suppression resistor R, thus energizing the third and fifth grids G3 and G5. Other electrodes such as the cathode K and the first, second and fourth grids G1, G2 and G4 are respectively connected to corresponding terminal pins 8 through conductors. The terminal pins 8 are extended through a stem 7 which is sealed to the end portion of the neck portion 3. Thus, the cathode K and the first, second and fourth grids G1, G2 and G4 are energized through the various terminal pins 8. In this case, particularly the focusing electrode is applied with a low voltage, that is, the fourth grid G4 and the corresponding terminal pin 8 are similarly coupled through an arc suppression resistor R. In the normal state, no current flows through these arc suppression resistors R so that the characteristics of the cathode ray tube are not affected. When a current produced by an arc discharge occurs, these arc suppression resistors R can produce a current suppression effect.

Arc suppression resistors R may be formed by mixing and sintering alumina, clay and graphite powder as disclosed, for example, in Japanese Patent Application No. 61-43205. This previously proposed arc suppression resistor will be described briefly hereinafter.

The known arc suppression resistor is manufactured as follows. A columnar shaped molded product is made from a ceramic material such as alumina containing carbon and is baked in an oxygen atmosphere. Then, only the carbon from the surface thereof is removed as carbon dioxide to thereby enable the baked ceramic product to have a high resistance due to the presence of a ceramic insulating layer made of alumina on the surface thereof. Since the carbon remains on the inside of the above baked ceramic product, the inside of the baked ceramic material has a ceramic resistor core made of alumina and carbon having a predetermined resistivity. In the above described arc suppression resistor, the graphite powder functions as a conductive element. Since a high resistance resistor can achieve a substantial arc suppression effect and the resistance value thereof can be controlled with ease, the arc discharge current can also be controlled very readily.

The aforementioned arc suppression resistor, however, employs graphite that essentially releases a large amount of gas so that when the resistor is heated by electrical current from the arc discharge, it releases gas. In the worst cases, it gradually releases gas even when in the static state. Thus, the conventional arc suppression resistor hinders the proper functioning of the electron emission cathode.

The gas is released because the ceramic insulating layer covering the surface of the above described arc suppression resistor is inherently porous. In other words, upon manufacturing, when the graphite near the surface of the alumina ceramic molded product containing graphite is baked to form the ceramic insulating layer, a large number of pores are formed through the ceramic insulating layer to release the burning gases therethrough.

SUMMARY OF THE INVENTION

The present invention seeks to provide an improved method for manufacturing a resistor element, particularly one for use with a color cathode ray tube of a television receiver. The invention also seeks to provide a method of manufacturing a resistor element which can suppress the undesirable influence of released gas due to an arc discharge accidentally occurring in the cathode ray tube. The method of the present invention also provides an arc suppression resistor of stable quality.

In accordance with the present invention, there is provided a method of manufacturing a resistor element comprising the steps of forming an arc suppression resistor having a ceramic insulating layer integrally formed on the surface of a resistor core, and baking the arc suppression resistor in a vacuum atmosphere under the following treatment conditions; a degree of vacuum in the range from $1\times10^{-3}$ Torr to $1\times10^{-7}$ Torr, a treatment temperature in the range from 250° C. to 500° C. and a treatment time of more than 30 minutes.

These and other objects, features and advantages of the present invention will become apparent from the description of illustrative embodiments, throughout which like reference numerals represent the same or similar elements.

BRIEF DESCRIPTION OF THE DRAWINGS

FIG. 5 is a table showing the evaluated results of the resistor elements made according to the present invention.

DESCRIPTION OF THE PREFERRED EMBODIMENTS

The present invention will be described in detail with reference to the accompanying drawings.

Figure 1:
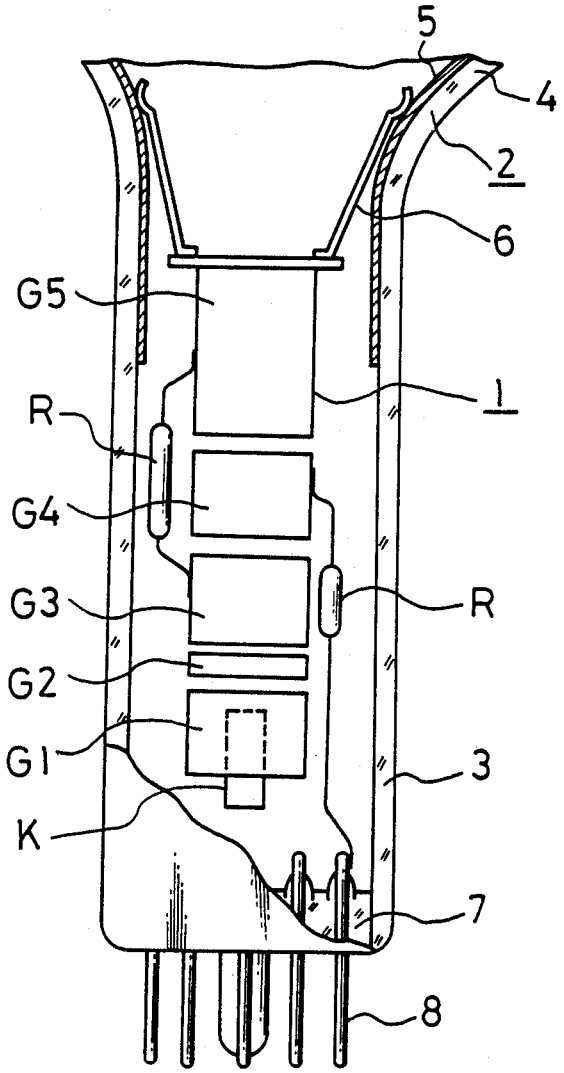
FIG. 1 is a schematic diagram of the main portion of a cathode ray tube to which an embodiment of arc suppression resistor made in accordance with the present invention is applied.
Figure 2:
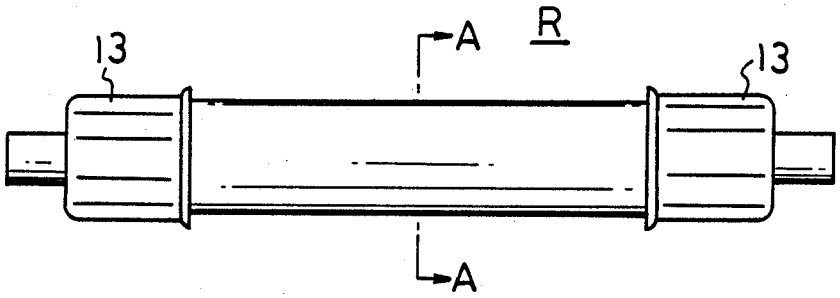
FIG. 2 is an enlarged side view of an embodiment of the arc suppression resistor manufactured by the present invention.
Figure 3:
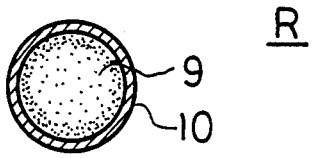
FIG. 3 is a cross-sectional view taken along the line A—A of FIG. 2.

Initially, as shown in FIGS. 2 and 3, a columnar shaped molded product is made of a alumina ceramic material containing carbon which is then baked in an oxygen atmosphere. As a result, the carbon is removed only from the surface thereof as carbon dioxide gas by selecting the baking temperature and time to form an alumina ($Al_2O_3$) ceramic insulating layer 10. The above described ceramic molded product contains the remaining carbon in its interior and therefore forms an $Al_2O_3$ ceramic resistor core 9 having a predetermined resistivity. Finally, the $Al_2O_3$ ceramic insulating layer 10 and the $Al_2O_3$ resistor core 9 are combined together in a unitary structure thus forming the arc suppression resistor R. As illustrated in FIG. 2, both ends of the arc suppression resistor R are covered with terminal caps 13 that electrically connect the central resistor core 9 in the arc suppression resistor R. The terminal caps 13 are each made of, for example, stainless steel. In this case, in order to achieve a satisfactory electrical connection between the resistor core 9 of the resistor R and the terminal caps 13, both end portions of the arc suppression resistor which are covered with the terminal caps 13 and which include the surface of the resistor core 9 exposed to both end surfaces of the arc suppression R are coated with a conductive layer such as aluminum or the like having good electrical conductivity by a thermal spraying method.

Figure 4:
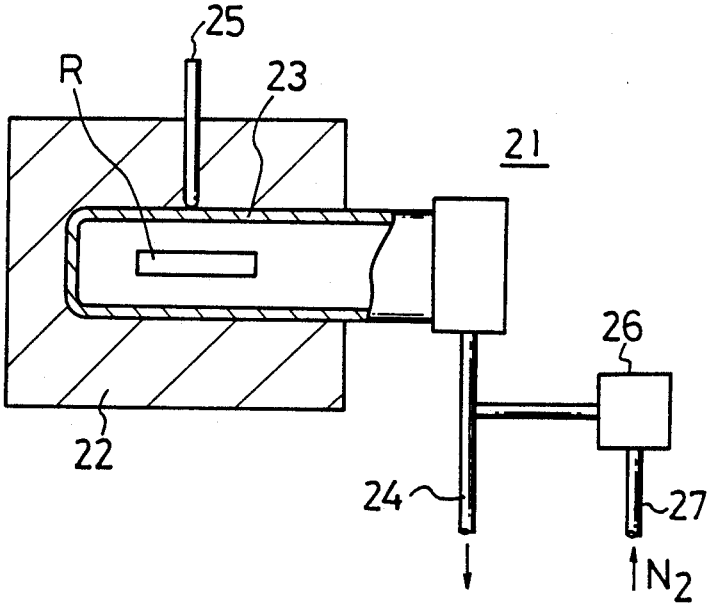
FIG. 4 is a schematic diagram of a vacuum baking apparatus used in the present invention.

The thus constructed arc suppression resistor R is put into a vacuum baking treatment apparatus 21 shown in FIG. 4 in which it undergoes a vacuum baking treatment. Thereafter, the baked arc suppression resistor R is mounted in a color cathode ray tube and then evaluated.

Referring to FIG. 4, the vacuum baking treatment apparatus 21 comprises an electric furnace 22, a furnace core tube 23, a vacuum exhaust orifice 24, a thermometer 25, a solenoid valve 26 and an entrance opening 27. In the vacuum baking treatment apparatus 21, the arc suppression resistor element R is placed within the furnace core tube 23 and then the air is evacuated to relieve a vacuum through the vacuum exhaust orifice 24 by means of a vacuum pump (not shown). Then, in the vacuum condition, the arc suppression resistor R is treated by a vacuum baking treatment. The vacuum pump may be a rotary pump, a diffusion pump or the like and the treatment temperature is measured by the thermometer 25. After the treatment, the solenoid valve 26 is energized and dried nitrogen gas is introduced into the furnace core tube 23 through the entrance opening 27. The evaluation conditions were as follows. The degrees of vacuum were $1\times10^{-3}$ Torr, $1\times10^{-4}$ Torr, $1\times10^{-6}$ Torr, and $1\times10^{-7}$ Torr. The treatment temperatures were 120° C., 200° C., 250° C., 300° C., 400° C. and 500° C. The treatment times were 15 minutes, 30 minutes, 60 minutes and 120 minutes. These conditions were combined with each other for evaluation. The evaluation was performed utilizing the following CQF (cathode quality factor) value:

$$CQF = MI_k/MI_k'$$

where $MI_k$ represents the maximum cathode current and $MI_k'$ the minimum cathode emission characteristic obtained from the mean value and the standard deviation of the statistically-searched results of the relationship between the cut-off voltage $E_{KCO}$ and the maximum cathode voltage $MI_k$.

Specifically, the evaluated results were obtained from the following equation:

$$CQF = MI_k/2.628E_{KCO}1.543$$

where the voltage $E_{C2}$ of the second grid G2 was 200 volts and the filament voltage $E_f$ was 6.3V.

FIG. 5 is a table illustrating the thus obtained evaluated results under various evaluation conditions. The cathodes of 5 color cathode ray tubes, each tube incorporating 3 cathodes, were employed as the samples for evaluation. In the test, each cathode damaged by an arc discharge was removed. In the evaluated results of FIG. 5, a circle having an inner circle at its center represents a remarkable improvement, a single circle represents a moderate improvement but still satisfactory, an open triangle represents an unsatisfactory result and a cross represents unimproved results.

The value provided after the accelerated test represents the CQF value obtained after an accelerated test corresponding to the life time. This value is a relative evaluation for the standard value. The variation with the lapse of time expresses the deterioration degree of the CQF value, from the value just after the cathode ray tube is manufactured to the value after the accelerated test is carried out.

FIG. 5 revealed the following results. The treatment temperature of 120° C. could not bring about any good results under any treatment time or degree of vacuum. A treatment temperature of 200° C. required a degree of vacuum more than $1\times10^{-4}$ Torr. This degree of vacuum required a treatment time of more than 60 minutes. A degree of vacuum of $1>10^{-6}$ Torr to $1\times10^{-7}$ required a treatment time of more than 30 minutes.

At a treatment temperature of 250° C., the degree of vacuum required was more than $1\times10^{-4}$ Torr. The degree of vacuum required a treatment time of more than 60 minutes. The degree of vacuum in the range of $1\times10^{-6}$ Torr to $1\times10^{-7}$ Torr required a treatment time of more than 30 minutes.

A treatment temperature of 300° C. required a degree of vacuum of more than $1\times10^{-4}$ Torr. This degree of vacuum required a treatment time of more than 30 minutes. The degree of vacuum in the range of $1\times10^{-6}$ Torr to $1\times10^{-7}$ Torr required a treatment time of more than 15 minutes.

The treatment temperature of 400° C. required a degree of vacuum of more than $1\times10^{-3}$ Torr A degree of vacuum in the range of $1\times10^{-3}$ Torr to $1\times10^{-4}$ Torr required a treatment time of more than 30 minutes. A degree of vacuum in the range from $1\times10^{-6}$ Torr to $1\times10^{-7}$ Torr required a treatment time of more than 15 minutes.

At a treatment temperature of 500° C., the degree of vacuum required was more than $1\times10^{-3}$ Torr. This degree of vacuum required a treatment time of more than 30 minutes. The degree of vacuum in the range of from $1\times10^{-4}$ Torr to $1\times10^{-7}$ Torr required a treatment time of more than 15 minutes.

The optimum conditions were found to be as follows: a treatment temperature in the range from 400° C. to 500° C., a degree of vacuum of $1\times10^{-6}$ Torr and a treatment time within the range of 1 to 2 hours.

Although the terminal cap members 13 made of stainless steel and used to cover both end portions of the arc suppression resistor were barely oxidized at a treatment temperature of less than 400° C., they were oxidized at a treatment temperature of 500° C. In order to avoid the terminal cap members 13 being oxidized at the treatment temperature of 500° C., the degree of vacuum should be at least $1\times10^{-6}$ Torr regardless of the treatment time. In this case, the vacuum baking treatment does not cause any problem if the arc suppression resistor R undergoes the vacuum baking treatment before the terminal cap members 13 are attached to both end portions thereof.

The arc suppression resistor R should be incorporated into the cathode ray tube as soon as possible after the vacuum baking treatment.

From an efficiency standpoint, the present invention suggests that the arc suppression resistor R be treated in the vacuum baking treatment such that the degree of vacuum is in the range from $1\times10^{-3}$ Torr to $1\times10^{-7}$ Torr, the treatment temperature is in the range from 250° C. to 500° C. and the treatment time is more than 30 minutes. According to the vacuum baking treatment of the present invention, it is possible to obtain an arc suppression resistor of stable quality.

The arc suppression resistor R of the invention shown in FIG. 2 can be modified into one in which the outside of the arc suppression resistor R is further covered with a cylindrically shaped outer insulating member made of alumina. Regardless of whether the outer insulating member is provided or not, the above mentioned vacuum baking treatment can be carried out.

In the present invention, since the arc suppression resistor formed of the resistor core and the ceramic insulating layer are integrally baked together on the surface and subjected to the vacuum baking treatment before being incorporated into the cathode ray tube, it is possible to obtain an arc suppression resistor of stable quality. When such an arc suppression resistor is used within the cathode ray tube, the resistor is suppressed from releasing out-gas so that a cathode ray tube of high quality can be manufactured.

It should be understood that the above description is presented by way of example including preferred embodiments of the invention and it will be apparent that many modifications and variations can be effected by one with ordinary skill in the art without departing from the spirit and scope of the novel concepts of the invention, so that the scope of the invention should be determined only by the appended claims.

We claim as our invention:

1. A method of manufacturing a resistor element which comprises:

providing an arc suppression resistor having a resistor core of predetermined resistance covered with an integral ceramic insulating layer, and baking said resistor in a vacuum atmosphere at a vacuum ranging from $1\times10^{-3}$ Torr to $1\times10^{-7}$ Torr, a temperature from 250° to 500° C. and a treatment time of more than 30 minutes.

2. A method according to claim 1, wherein the temperature is in the range from 400° to 500° C.

3. A method according to claim 1 which includes the step of sealing the resistor after baking into a cathode ray tube.

4. A method according to claim 1 which includes the step of forming a peripheral layer of alumina over said resistor prior to baking.

5. A method according to claim 4 which includes the step of baking the resistor under the stated conditions after application of said peripheral layer.

6. A method according to claim 1, wherein said core and said insulating layer are composed of a monolithic body of alumina, and said core has conductive carbonaceous particles distributed therethrough.

* * * * *